US012474133B1

(12) United States Patent
Herring

(10) Patent No.: US 12,474,133 B1
(45) Date of Patent: Nov. 18, 2025

(54) FOREND KIT AND FIREARM COMPRISING COMPONENTS OF THE KIT

(71) Applicant: Ares Defense Systems, Inc., Melbourne, FL (US)

(72) Inventor: Geoffrey A. Herring, Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 0 days.

(21) Appl. No.: 18/767,183

(22) Filed: Jul. 9, 2024

(51) Int. Cl.
*F41A 5/24* (2006.01)
*F41A 21/48* (2006.01)
*F41C 23/16* (2006.01)

(52) U.S. Cl.
CPC ..... *F41A 5/24* (2013.01); *F41A 21/482* (2013.01); *F41C 23/16* (2013.01)

(58) Field of Classification Search
CPC ..... F41A 5/24; F41A 5/26; F41A 5/28
See application file for complete search history.

(56) References Cited

U.S. PATENT DOCUMENTS

2014/0305297 A1* 10/2014 Hall ..... F41A 5/18 89/193

OTHER PUBLICATIONS

Pigsnguns, "Replacing My AR15 SBR PigTail Gas Tube (Warranty Replacement)", Nov. 30, 2014, YouTube, <https://www.youtube.com/watch?v=vMMIIDEB5_o>, Entire Video. (Year: 2014).*

* cited by examiner

*Primary Examiner* — Jonathan C Weber
(74) *Attorney, Agent, or Firm* — David O. Simmons; IVC Patent Agency

(57) ABSTRACT

A forend kit or firearm comprising same may include a forend and a gas tube. The forend has a mounting body and a hand-gripping body extending from the mounting body. A first portion of the gas tube extends from a first end of the gas tube to a central portion of the gas tube and a second portion of the gas tube extends from a second end of the gas tube to the central portion. The central portion includes an arcuate segment vertically offsetting the first portion of the gas tube from the second portion of the gas tube (e.g., a 180 degree curvature). The first and second portions of the gas tube may extend parallel to each other. A discharge gas passage of the gas block and/or the barrel may include a circumferential portion for allowing angular clocking between the gas block and the barrel.

24 Claims, 9 Drawing Sheets

FOREND KIT AND FIREARM COMPRISING COMPONENTS OF THE KIT

FIELD OF THE DISCLOSURE

The disclosures made the Specification hereof relate generally to firearms and, more particularly, to firearms having a gas tube extending between a barrel-mounted gas block and a receiver-mounted, gas-energized bolt carrier group.

BACKGROUND

Rifles (i.e., firearms) having a gas tube extending between a barrel-mounted gas block and a receiver-mounted, gas-energized bolt carrier group are well known, as is the following general description of their construction and operation. Firearms of this type are commonly referred to as being gas-operated. The gas block is mounted on a barrel of the rifle and a bolt carrier (i.e., a receiver-mounted action component) is slidably disposed within a bore of a receiver of the firearm (i.e., typically an upper receiver.) The barrel has a gas-regulating orifice known as a "gas-port" that is communicatively coupled to a discharge gas passage within the gas block. A first end of a gas tube is fixedly engaged within the gas block and is communicatively coupled to the discharge gas passage of the gas block. A second end of the gas tube is slidably engaged with a gas key attached to the bolt carrier.

Discharge of a round of ammunition results in hot expanding gas generated from discharge of a round of ammunition (i.e., discharge gas) traveling from the bore of the barrel, through the passageway of the gas block, though a central passage of the gas tube, and forcibly act of the bolt carrier to urge the carrier rearward (i.e., via gas pressure thereof) from the battery position to a displaced (i.e., recoiled position). This forcible rearward movement causes unlocking of a bolt mounted on the bolt carrier from lugs of an extension of the barrel followed by rearward movement of the bolt carrier until its rearward movement is arrested by a recoil spring of the rifle. More specifically, upon entering the cavity in the bolt carrier, the pressure generated by the expanding discharge gas forces a separation of the bolt and bolt carrier attempting to propel them in opposite directions. Because the bolt is fixed against the breech face of the barrel extension, the bolt carrier travels in the rearward (i.e., recoil) direction. Once rearward movement of the bolt carrier group is fully arrested by the recoil spring, the now-charged recoil spring urges the bolt carrier forward and back into the battery position. During the rearward movement of the bolt carrier, a cartridge of a spent round of ammunition is engaged by and ejected from the firearm by engagement with the bolt. During the forward movement of the bolt carrier back into the battery position, an available round of ammunition within a magazine is engaged by and chambered by engagement with the bolt.

In many instances, a handguard extends from the receiver to which the barrel is attached forward along at least a portion of the length of the barrel. The handguard forms an enclosure surrounding the underlying portion of the barrel to protect the barrel from damage, to protect a shooter's supporting hand from the high temperature of the barrel, and to provide a structure upon which accessories may be mounted. However, in some other instances, a shooter may choose to configure their rifle such that there is no barrel-surrounding handguard in place. Accordingly, in such other instances, a structure that still protects the barrel from damage, that protects a shooter's supporting hand from the high temperature of the barrel, and that may provide a structure upon which accessories may be mounted would be beneficial, desirable and useful.

SUMMARY OF THE DISCLOSURE

Embodiments of the disclosures made herein are directed to gas-operated firearms. More specifically, embodiments of the disclosures made herein are directed to gas-operated rifles not having a barrel-surrounding handguard. Instead, rifles configured in accordance with the embodiments of the disclosures made herein have a forend in place of barrel-surrounding handguard. For example, when the gas-operated rifle is configured as a sporting rifle, a forend may be desired to impart more traditional styling to the rifle. U.S. Pat. No. 8,397,623, which is incorporated herein in its entirety by reference, discloses an example of such a gas-operated sporting rifle.

In one or more embodiment of the disclosures made herein, a rifle comprises a receiver, a barrel, a forend, a gas block, and a gas tube. The barrel is operably secured to the receiver and comprises a discharge gas passage including a portion extending through a wall defining a bore of the barrel. The forend is attached to the receiver. A hand-gripping body of the forend extends forward of the receiver below the barrel. The gas block is mounted on the barrel with the discharge gas passage of the barrel exposed to a discharge gas passage of the gas block for enabling flow of discharge gas from within the bore of the barrel through the discharge gas passage of the barrel and into the discharge gas passage of the gas block. The gas tube has a first portion, a second portion, and a central portion. The first portion extends from a first end of the gas tube to the central portion and the second portion extends from a second end of the gas tube to the central portion. The first end of the gas tube is operably attached to the gas block for receiving discharge gas therefrom and the second end of the gas tube is located within the receiver for delivering discharge gas to the receiver. The first portion of the gas tube extends along a length of the barrel in a space between the barrel and the hand-gripping body of the forend. The central portion of the gas tube includes an arcuate segment that extends from below the barrel to above the barrel.

In one or more embodiment of the disclosures made herein, a forend kit comprises a forend and a gas tube. The forend has a mounting body and a hand-gripping body extending from the mounting body. The gas tube has a first portion, a second portion, and a central portion. The first portion extends from a first end of the gas tube to the central portion and the second portion extends from a second end of the gas tube to the central portion. The central portion includes an arcuate segment that transversely (i.e., laterally and/or vertically) offsets the first portion of the gas tube from the second portion of the gas tube.

In one or more embodiment of the disclosures made herein, a gas tube comprises a first portion, a second portion, and a central portion. The first portion extends from a first end of the gas tube to the central portion and the second portion extends from a second end of the gas tube to the central portion. The central portion includes an arcuate segment that transversely offsets the first portion of the gas tube from the second portion of the gas tube.

In some embodiments of the disclosures made herein, the forend kit may comprise at least one of a gas block and a barrel.

In some embodiments of the disclosures made herein, the arcuate segment is located within a mounting body of the forend.

In some embodiments of the disclosures made herein, an entire portion of a hand-gripping body of the forend is detached from the gas tube, the gas block, and the barrel.

In some embodiments of the disclosures made herein, the gas block has a discharge gas passage including a circumferential gas flow channel within a central passage surface of the gas block.

In some embodiments of the disclosures made herein, the barrel has a discharge gas passage including a circumferential gas flow channel within an exterior surface of a gas block mounting body of the barrel.

In some embodiments of the disclosures made herein, the arcuate segment extends 180 degrees around a longitudinal reference axis that extends generally parallel to at least one of the first portion of the gas tube and the second portion of the gas tube (e.g., extending parallel with or collinearly with a centerline longitudinal axis of the barrel of a firearm).

In some embodiments of the disclosures made herein, the first portion of the gas tube and the second portion of the gas tube extend parallel to each other.

In some embodiments of the disclosures made herein, all or a portion of the arcuate segment has a generally uniform radius from a longitudinal reference axis that extends generally parallel to at least one of the first portion of the gas tube and the second portion of the gas tube.

In some embodiments of the disclosures made herein, the arcuate segment is bisected by a plane extending perpendicular to a longitudinal reference axis that extends generally parallel to at least one of the first portion of the gas tube and the second portion of the gas tube.

These and other objects, embodiments, advantages and/or distinctions of the present invention will become readily apparent upon further review of the following specification, associated drawings and appended claims.

DETAILED DESCRIPTION

FIGS. 1-13 depict various aspects of a forend arrangement in accordance with one or more embodiments of the disclosures made herein. Such forend arrangement are particularly configured for use with gas-operated rifles that have a bolt carrier group that is gas-energized. Advantageously, a forend arrangement in accordance with one or more embodiments of the disclosures made herein may be implemented in a direct replacement manner on compatible firearms. In this respect, no modification to existing components of an existing firearm need to be modified. In some instances, a different barrel nut (i.e., a forend-compatible barrel nut) may be required to be used in place of an existing barrel nut of the firearm.

Figure 1:
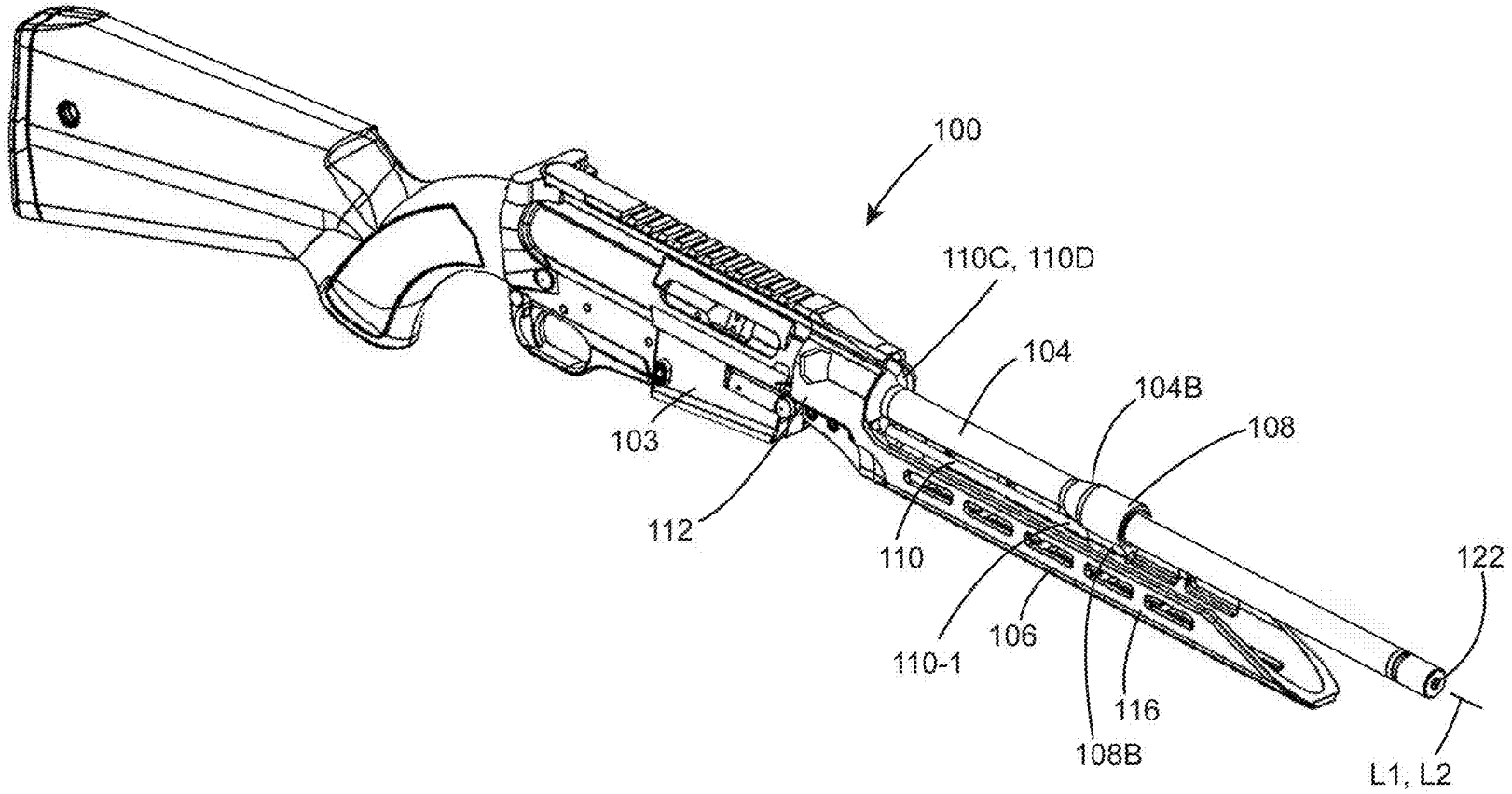
FIG. 1 is a first perspective view showing a gas-operated rifle in accordance with one or more embodiments of the disclosures made herein.
Figure 2:
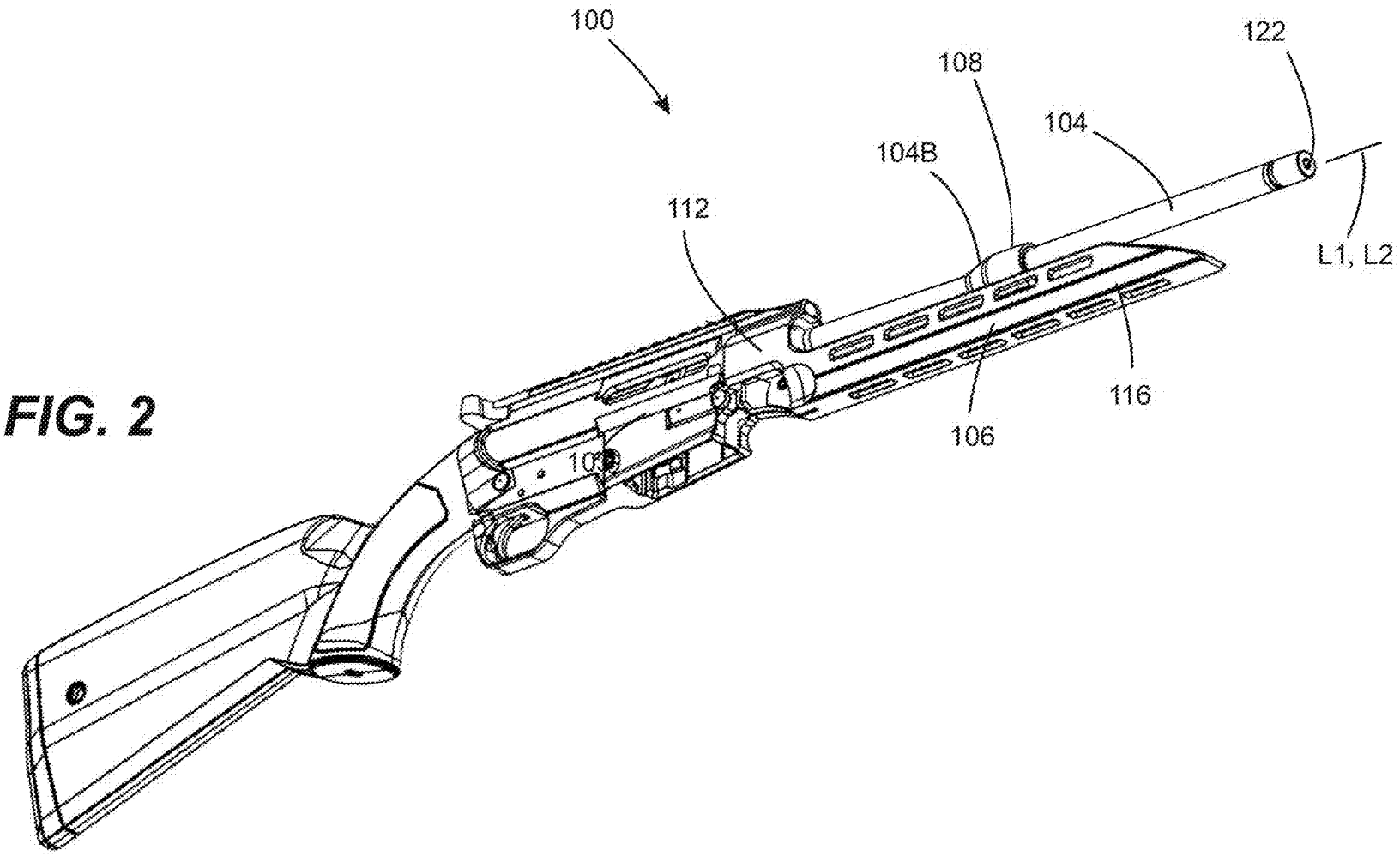
FIG. 2 is a second perspective view of the gas-operated rifle shown in FIG. 1.
Figure 3:
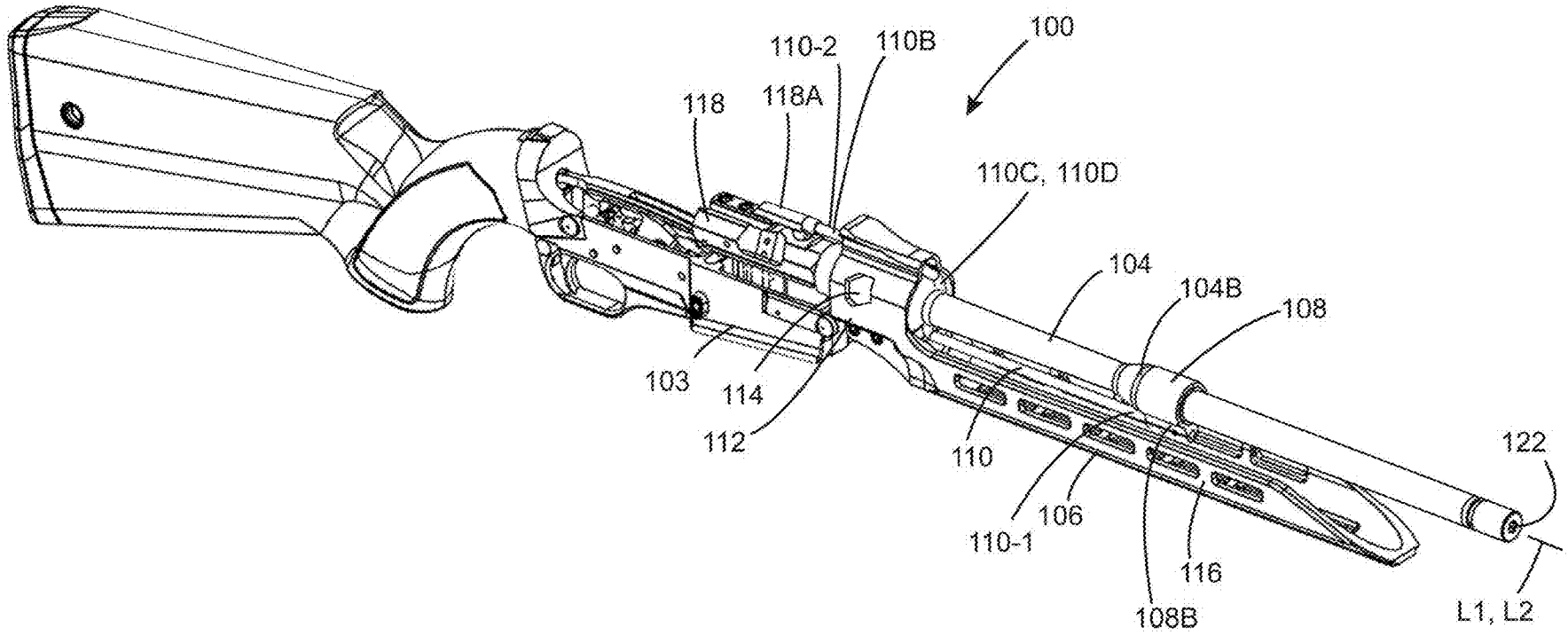
FIG. 3 is a third perspective view of the gas-operated rifle shown in FIG. 1, where the upper receiver and charging handle have been omitted from the view.
Figure 4:
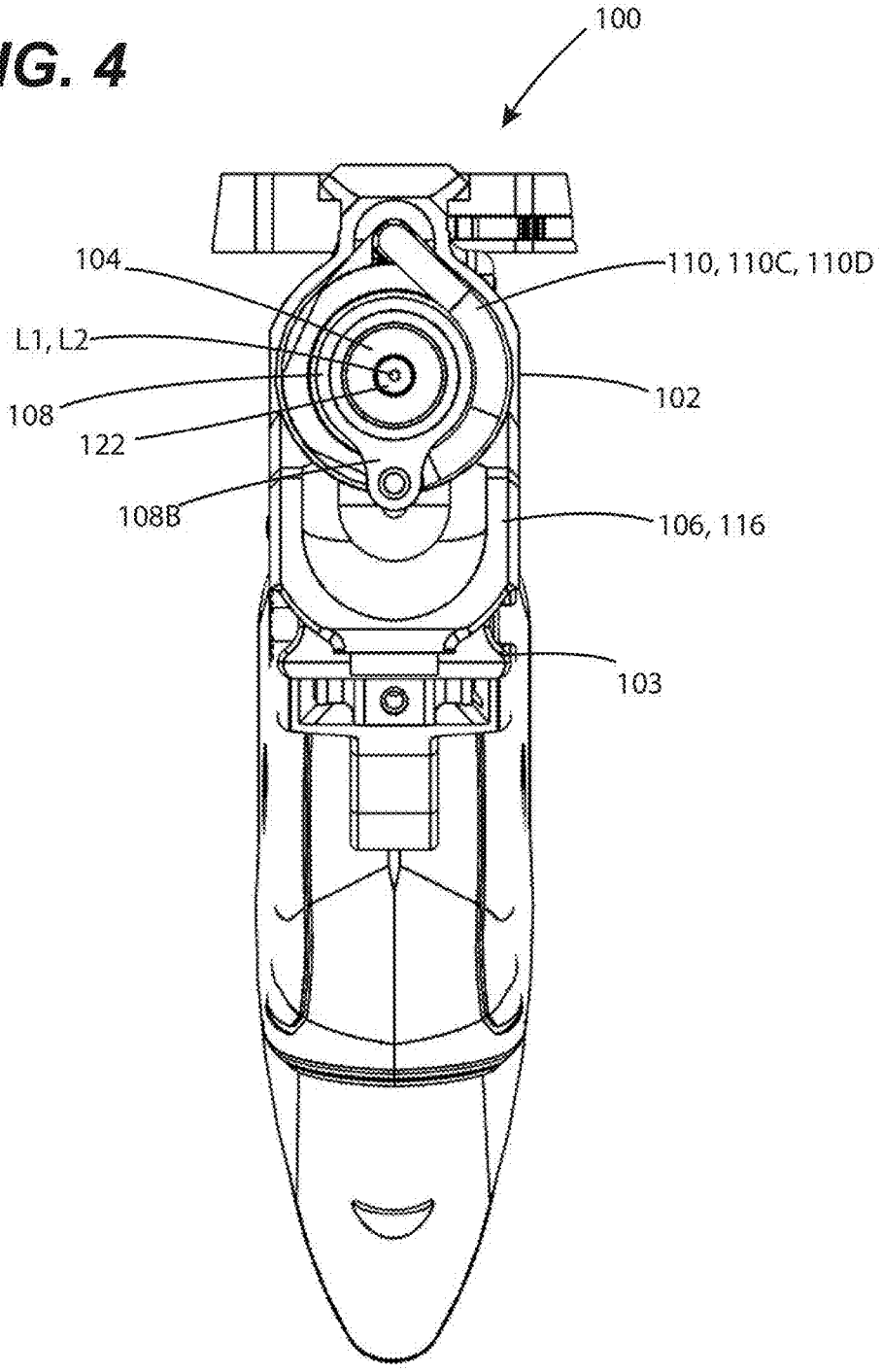
FIG. 4 is a front view of the gas-operated rifle shown in FIG. 1.
Figure 5:
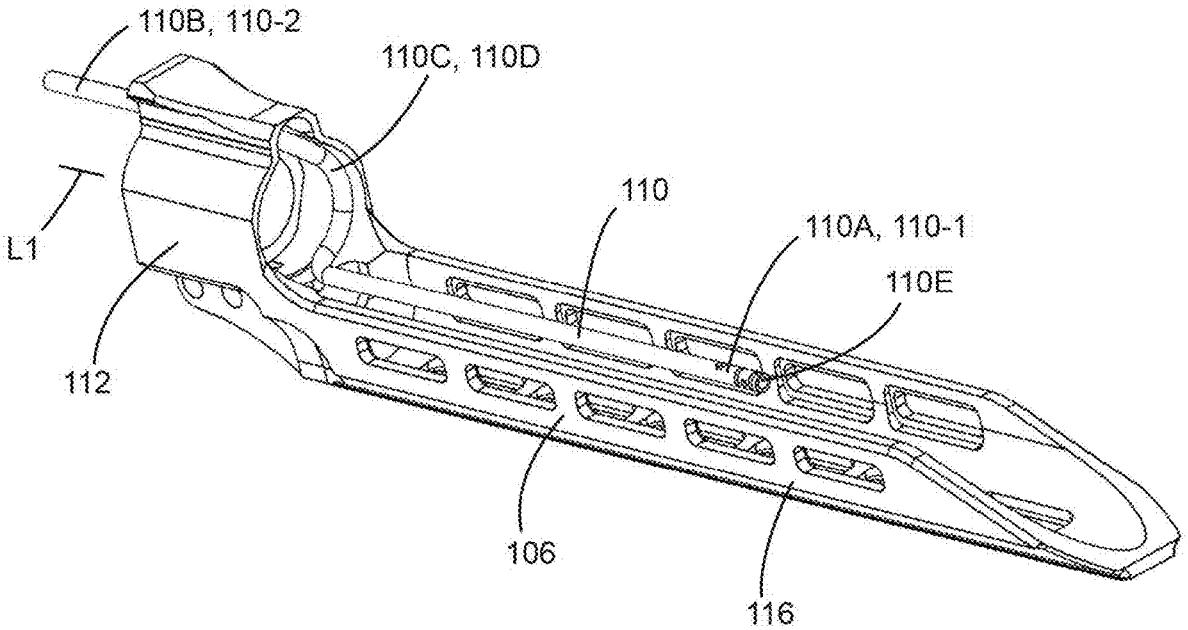
FIG. 5 is a first perspective view of a forend and a gas tube of the gas-operated rifle shown in FIG. 1.
Figure 6:
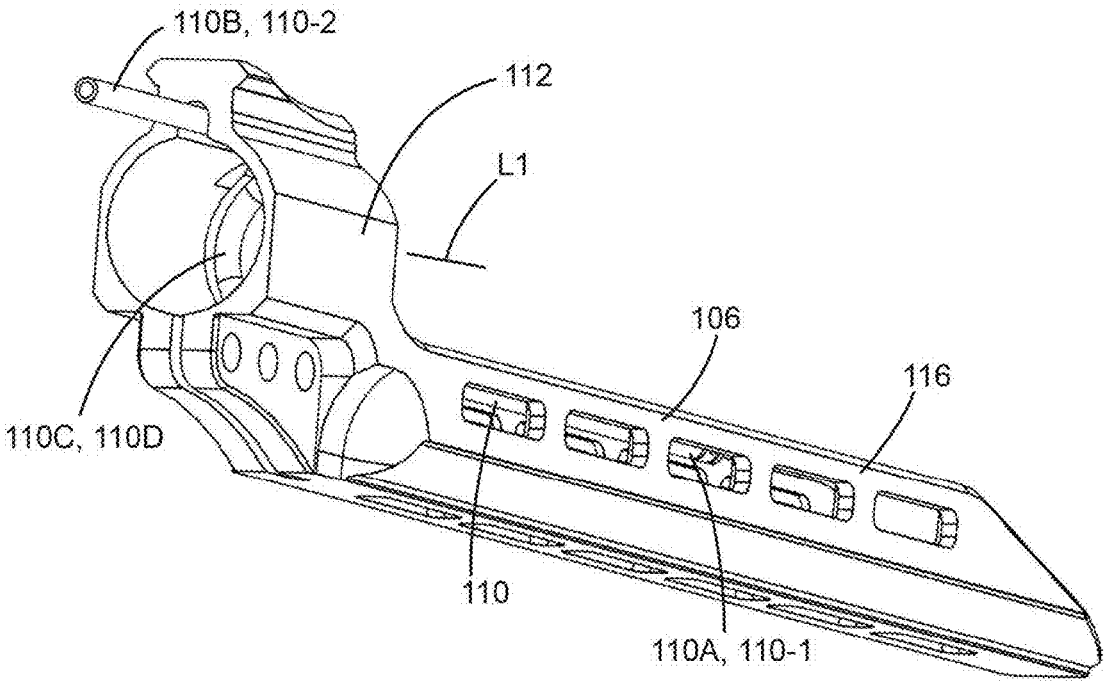
FIG. 6 is a second perspective view of the forend and the gas tube of the gas-operated rifle shown in FIG. 1.
Figure 7:
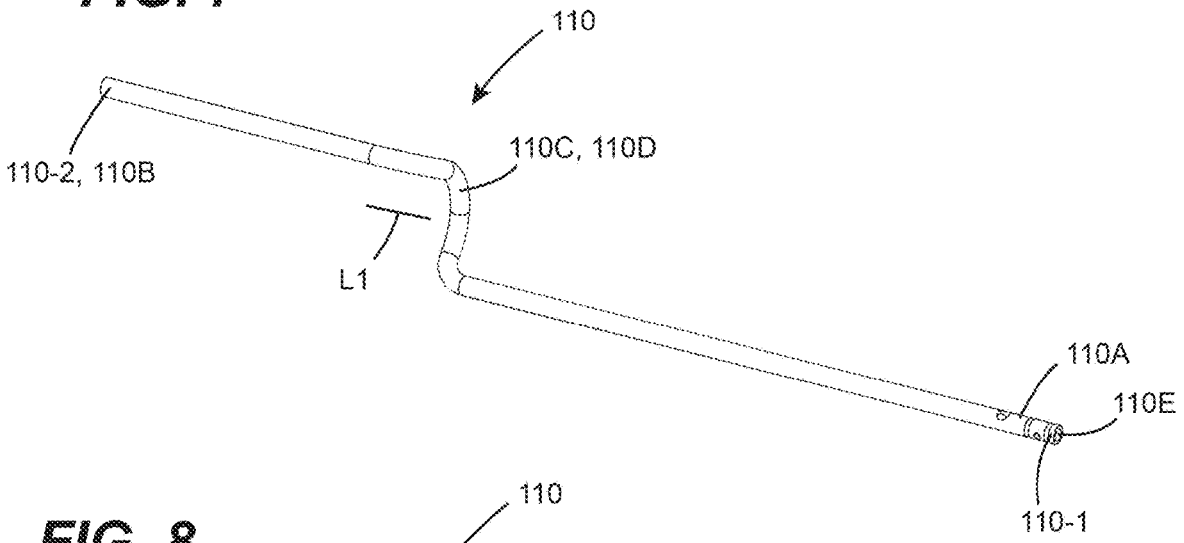
FIG. 7 is a perspective view of the gas tube of the gas-operated rifle shown in FIG. 1.
Figure 8:
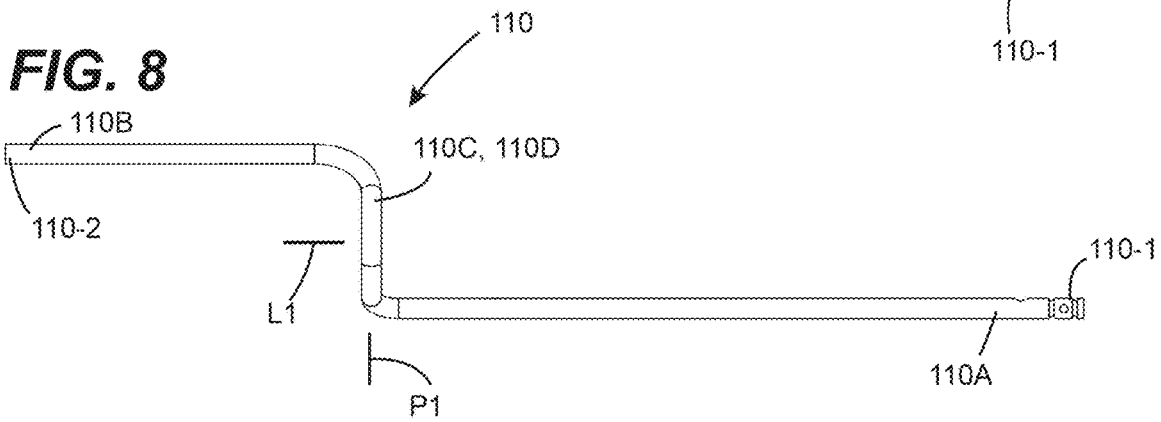
FIG. 8 is a side view of the gas tube of the gas-operated rifle shown in FIG. 7.
Figure 9:
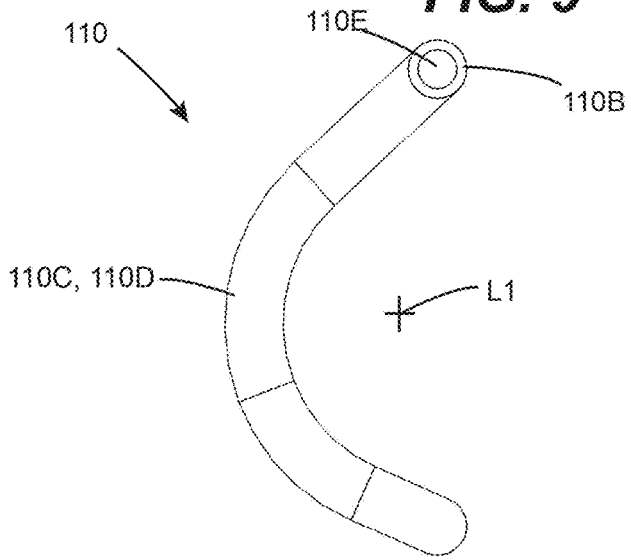
FIG. 9 is an end view of the gas tube of the gas-operated rifle shown in FIG. 7.

Referring to FIGS. 1-4, a rifle 100 in accordance with one or more embodiments of the disclosures made herein comprises a receiver 102, a barrel 104, a forend 106, a gas block 108, and a gas tube 110. The barrel 104 is operably secured to the receiver 102 for enabling required operational functionalities associated with discharge of a round of ammunition and discharge of a projective thereof. The gas block 108 is a discrete body (i.e., machined as a discrete component) that is mounted on a gas block mounting body 104B (best shown in FIGS. 12 and 13) of the barrel 104. As shown, the receiver 102 is an upper receiver that is attached to a lower receiver 103. Other receiver configurations are contemplated for use with forend arrangements in accordance with embodiments of the disclosures made herein. The forend 106 is attached to the receiver 102. The forend 106 may be attached to the receiver 102 directly or indirectly. For example, as shown in FIG. 3, the forend 106 may include a mounting body 112 that is fixedly engaged with a barrel nut 114 (FIG. 3) that secures the barrel 104 to the receiver 102. To this end, the mounting body 112 may be configured to be engaged with the barrel nut 114 via forcible compression of the mounting body 112 around the barrel nut 114. A hand-gripping portion 116 of the forend 106 is attached to and extends forward from the mounting body 112. In preferred embodiments, the hand-gripping portion 116 of the forend 106 is unitarily formed (e.g., milled, cast, molded, or the like) with mounting body 112 of the forend 106.

Referring now to FIGS. 1-9, the gas tube 110 has a first portion 110A, a second portion 110B, and a central portion 110C. The first portion 110A extends from a first end 110-1 of the gas tube 110 to the central portion 110C and the second portion 110B extends from a second end 110-2 of the gas tube 110 to the central portion 110C. In some embodiments, the first portion 110A of the gas tube 110 and the second portion 110B of the gas tube 110 may extend parallel to each other. The first portion 110A of the gas tube 110 extends along a length of the barrel 104 in a space between the barrel 104 and the hand-gripping body 116 of the forend 106.

The central portion 110C of the gas tube 110 includes an arcuate segment 110D that extends from below the barrel 104 to above the barrel 104. The arcuate segment 110D vertically offsets the first portion 110A of the gas tube 110 from the second portion 110B of the gas tube 110. To this end, the arcuate segment may extend 180 degrees around a longitudinal reference axis L1 that extends collinearly with or generally parallel to the longitudinal centerline axis L2 of the barrel 104 and that extends generally parallel to the first portion 110A of the gas tube 110, the second portion 110B of the gas tube 110, or both. All or a portion of the arcuate segment 110D may have a generally uniform radius from the longitudinal reference axis L1. The arcuate segment 110D may be perpendicularly situated relative to the first and second portions 110A, 110B of the gas tube 110 such that it is bisected by a reference plane P1 (FIG. 8) that extends perpendicular to the longitudinal reference axis L1. The arcuate segment 110D may be located within the mounting body 112 of the forend 106. Preferably, an entire portion of the hand-gripping body 116 of the forend 106 is completely detached from the barrel 104, the gas block 108, or the gas tube 110. For example, the hand-gripping body 116 of the forend 106 may be free-standing from the mounting body 112 such that the hand-gripping body 116 does not touch the barrel 104, the gas block 108, or the gas tube 110.

Figure 10:
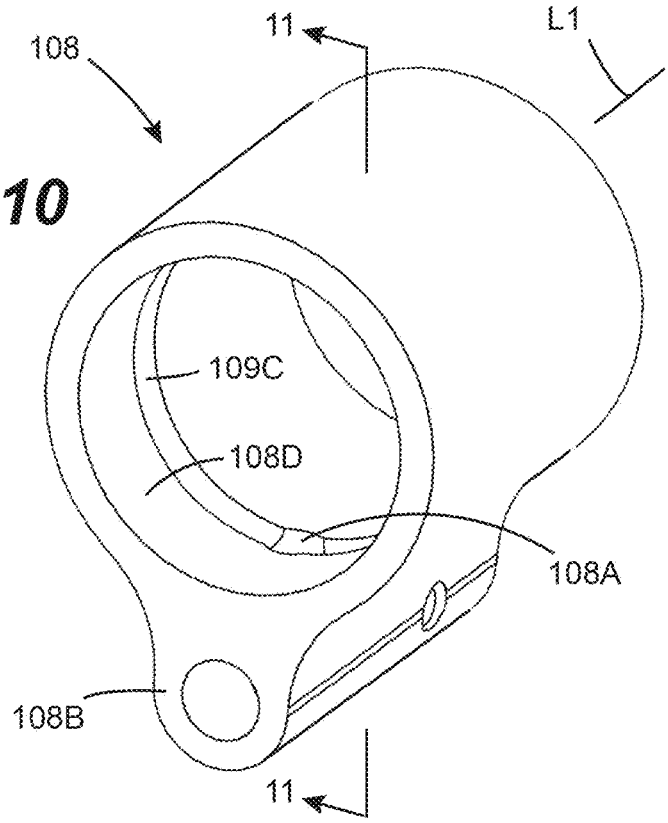
FIG. 10 is a perspective view of a gas block of the gas-operated rifle shown in FIG. 1.
Figure 11:
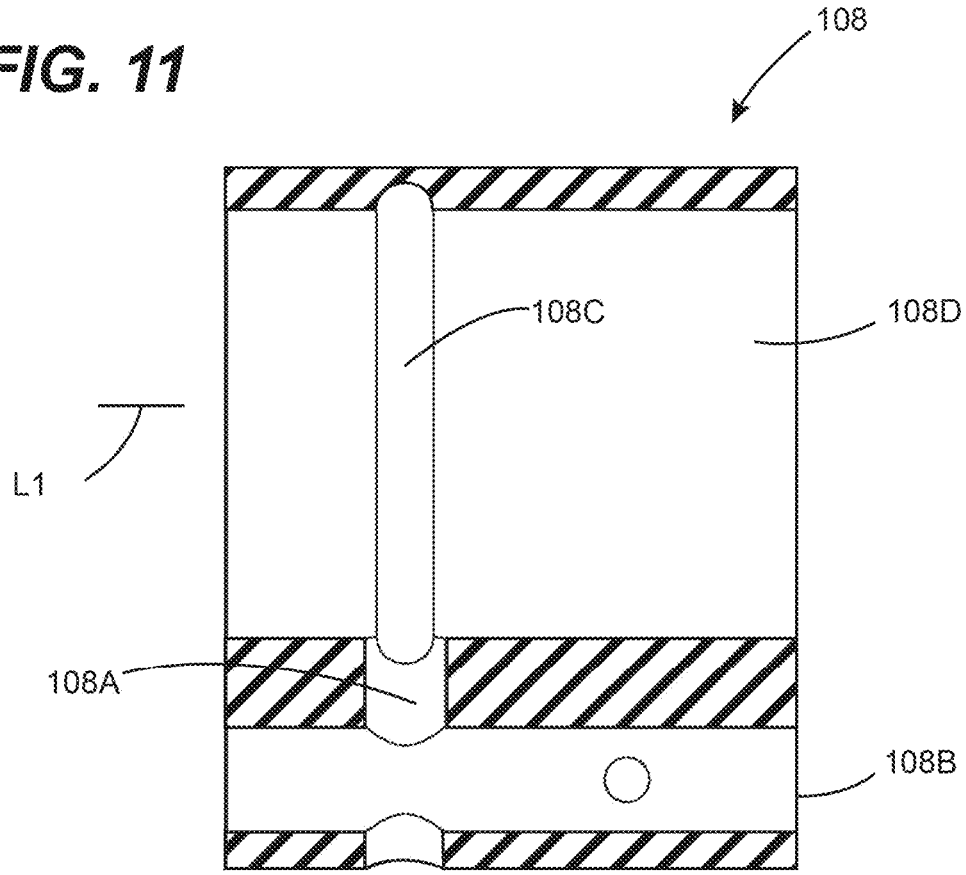
FIG. 11 is a cross-sectional view taken along the line 11-11 in FIG. 10.
Figure 12:
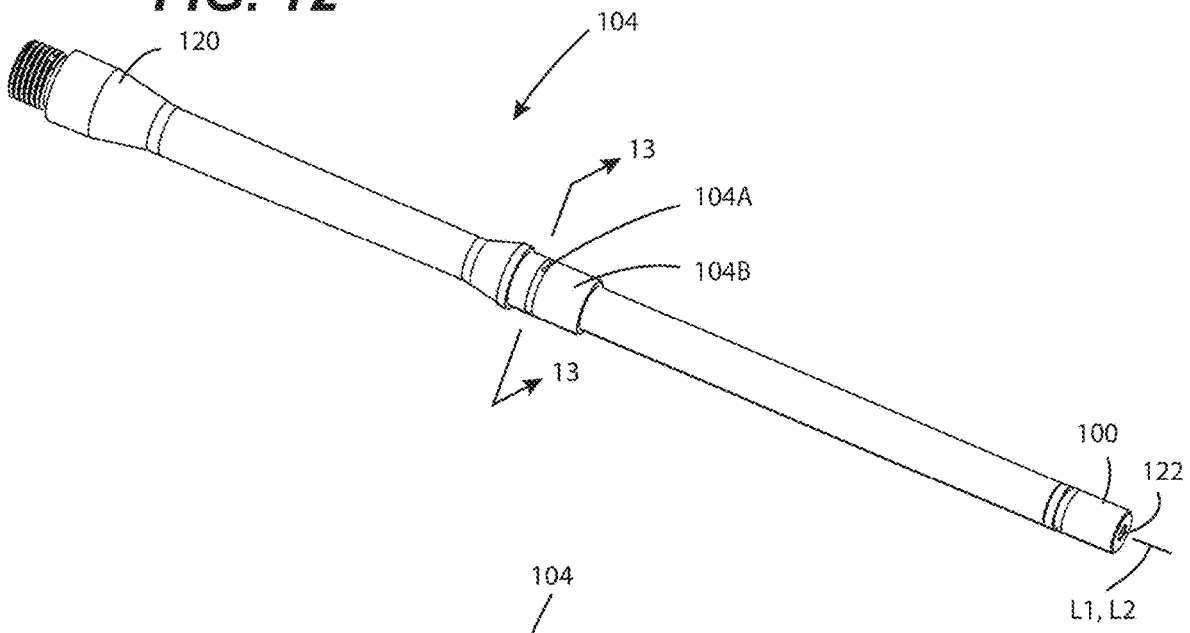
FIG. 12 is a perspective view of a first embodiment of a barrel compatible with the gas-operated rifle shown in FIG. 1.
Figure 13:
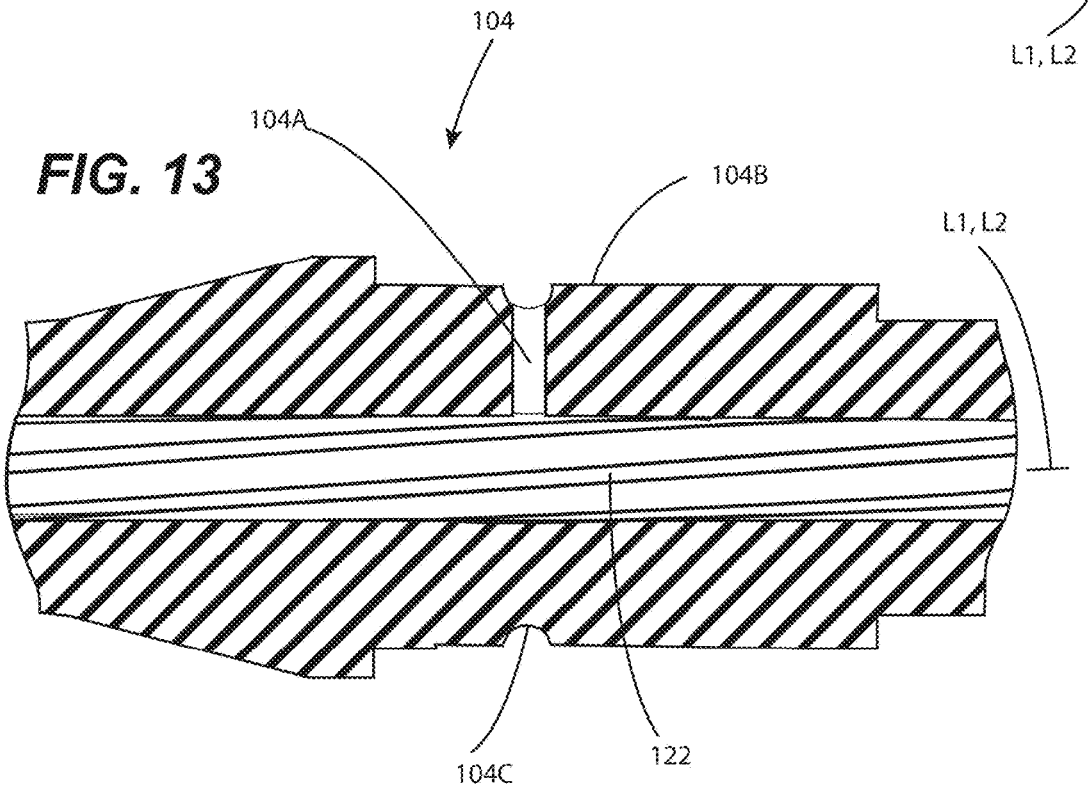
FIG. 13 is a cross-sectional view taken along the line 13-13 in FIG. 12.

The barrel 104, the gas block, 108, and the gas tube 110 are jointly configured for energizing bolt carrier group cycling using discharge gas. As is well known, a bolt of a carrier group carrier 118 (FIG. 3) in the receiver 102 and a barrel extension 120 (FIG. 12) of the barrel 104 jointly defined a chamber within which a round of ammunition is discharged. To enable such energizing of the bolt carrier group cycling using discharge gas, discharge gas resulting from discharge of a round of ammunition within the chamber is routed from a bore 122 of the barrel 104 through a discharge gas passage 104A (FIGS. 12 and 13) of the barrel 104 (i.e., extending through a sidewall thereof), through a discharge gas passage 108A of the gas block 108, and into a gas tube receiving passage 108E of the gas block 108 (FIGS. 10 and 11).

The first end 110-1 of the gas tube 110 is operably engaged with (e.g., fixedly coupled to via a pinned connection) the gas block 108 (i.e., discharge gas passages thereof). The discharge gas passage 104A of the barrel 104 is exposed to (e.g., aligned with) the discharge gas passage 108A of the gas block 108 for enabling discharge gas to be routed into and through a discharge gas passage 110E (FIGS. 5, 7, and 9) of the gas tube 110. The first portion 110-1 of the gas tube 110 may include one or more sidewall apertures (well known in the art) that are exposed to the discharge gas passage 108A of the gas bock 108, thereby enabling the discharge gas to enter the discharge gas passage 110E (FIGS. 5, 7, and 9) of the gas tube 110 through a sidewall of the gas tube 110. As is well known, the first end 110-1 of the gas tube 110 is obstructed to inhibit discharge gas within the discharge gas passage 110E of the gas tube 110 from flowing out of the gas tube 110 at its first end 110-1. As is also well known, a second end 110-2 (FIGS. 3, 5, and 6) of the gas tube 110 is located within the receiver 102 and may be operably engaged with a gas key 118A (FIG. 3) of the bolt carrier group 118 whereby pressure provided by expansion of the discharge gas urges the bolt carrier group 118 in a rearward direction within a bore of the receiver 104 to initiate action cycling of the bolt carrier group.

In some instances, as is well known in the art, the barrel 104 of the firearm 100 may be configured such that the discharge gas passage 104A of the barrel 104 is located at the 12 o'clock position. As shown, a gas tube mounting body 108B of the gas body 108 is located below the barrel 104. Preferably, the gas tube mounting body 108B of the gas body 108 is located at the 6 o'clock position. For retrofitting purposes, it is thus advantageous for the gas block 108 to be configured to be mounted on the barrel 104 even though the discharge gas passage 104A of the barrel 104 is located at the 12 o'clock position and the gas tube mounting body 108B of the gas body 108 (i.e., including the discharge gas passage 108A of the gas block 108) is located at the 6 o'clock position (i.e., 180 degrees away from each other. To provide for discharge gas communication in such an arrangement, the discharge gas passage 108A of the gas block 108 may include a circumferential gas flow channel 108C within a central passage surface 108D of the gas block 108. Alternatively or additionally, for providing for such discharge gas communication, the discharge gas passage 104A of the barrel 104 may include a circumferential gas flow channel 104C (FIGS. 12 and 13) within an exterior surface 104B of the gas block mounting body 104B of the barrel 104. It is herein that circumferential gas flow channel may fully or partially extend around a circumference of an associated surface.

Figure 14:
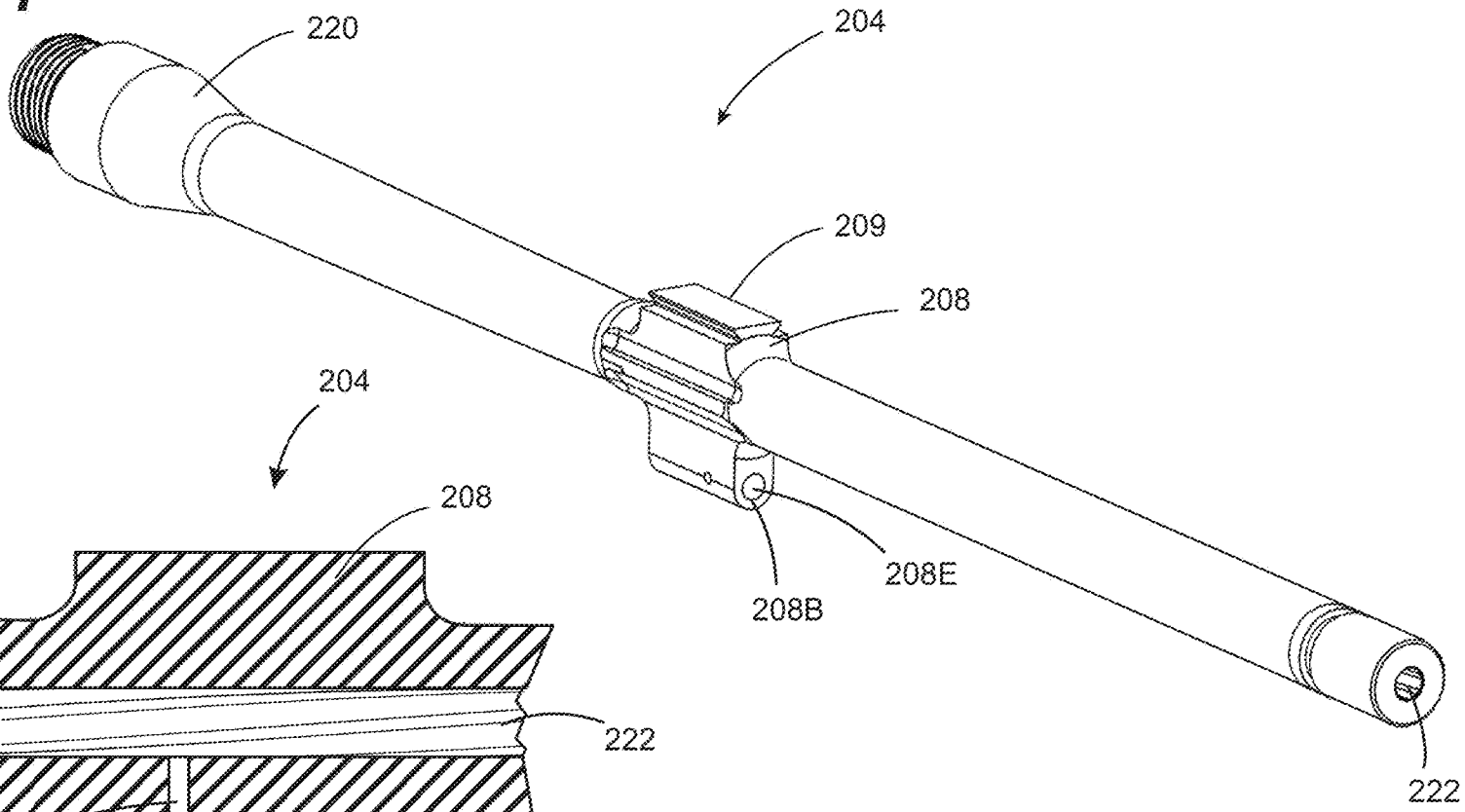
FIG. 14 is a perspective view of a second embodiment of a barrel compatible with the gas-operated rifle shown in FIG. 1.
Figure 15:
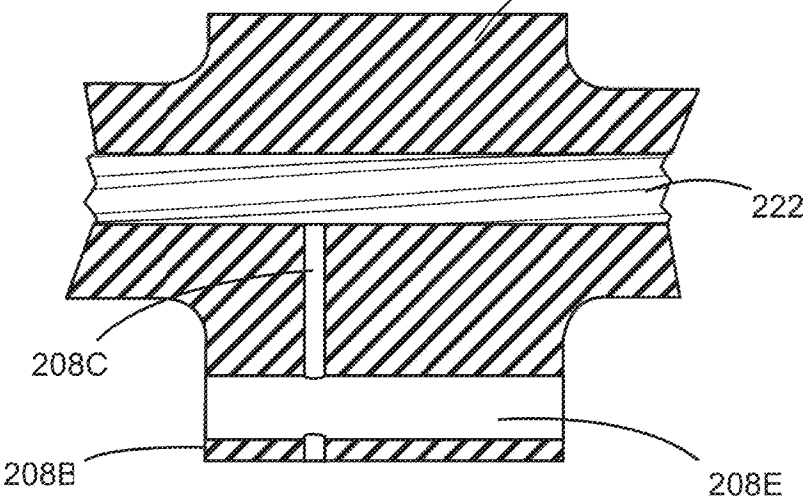
FIG. 15 is a fragmentary cross-sectional view taken along the line 15-15 in FIG. 14.

Referring now to FIGS. 14 and 15, a barrel 204 is shown. The barrel 204 may be compatible with the gas-operated rifle shown in FIG. 1 (e.g., may be constructed to be interchangeable with the barrel 104 discussed above). The underlying distinction between the barrel 204 shown in FIG. 14 and the barrel 104 discussed above is that the barrel 204 includes a gas block 208 that is a unitarily-formed component of the barrel 208. For example, the barrel 204 and the gas block 208 may be formed (e.g., machined) of or from a single piece of material whereas the gas block 108 discussed above is a discrete component (e.g., a machined piece of material) that is attached to the barrel 104. To this end, the barrel 204 and the gas block 208 share a common discharge gas passage 208C (i.e., extending through a shared wall of the barrel 204 and the gas block 208) that intersects with a gas tube receiving passage 208E of the gas block 208. As shown, the gas block 208 as well as other gas blocks in accordance with embodiments of the disclosures made herein (e.g., the gas block 108) may include an accessory mounting feature 209 such as, for example a dovetail member feature, a T-slot feature, or structure suitably configured for having an accessory item engaged therewith. The accessory mounting feature 209 is engageable with a mating mounting feature 209 of an accessory.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A forend kit, comprising:

a forend having a mounting body and a hand-gripping body extending from the mounting body; and a gas tube having a first portion, a second portion, and a central portion, wherein the first portion extends from a first end of the gas tube to a first end of the central portion, wherein the second portion extends from a second end of the gas tube to a second end of the central portion, wherein the central portion includes an arcuate segment, and wherein the first end of the central portion of the gas tube is vertically offset from the second end of the central portion of the gas tube for enabling the first end of the gas tube to the engaged with a discharge gas system of a firearm at a location above a bore centerline axis of a barrel of the firearm and enabling the second end of the gas tube to the engaged with the discharge gas system at a location below the bore centerline axis.

2. The forend kit of claim 1, further comprising at least one of:

a gas block having a discharge gas passage including a circumferential gas flow channel within a central passage surface of the gas block; and a barrel having a discharge gas passage including a circumferential gas flow channel within an exterior surface of a gas block mounting body of the barrel;

wherein the gas block is separately formed from and is attached to the barrel.

3. The forend kit of claim 1 wherein a length of the central segment results in the first end of the central portion being up to 180 degrees away from the second end of the central portion relative to a longitudinal reference axis that extends generally parallel to at least one of the first portion of the gas tube and the second portion of the gas tube.

4. The forend kit of claim 3 wherein:

at least a portion of the arcuate segment has a generally uniform radius from the longitudinal reference axis;

the longitudinal reference axis extends parallel to the first and second portions of the gas tube;

the first end portion of the gas tube and the first end of the central portion are located vertically above the longitudinal reference axis; and the second end portion of the gas tube and the second end of the central portion are located vertically below the longitudinal reference axis.

5. The forend kit of claim 3, further comprising at least one of:

a gas block having a discharge gas passage including a circumferential gas flow channel within a central passage surface of the gas block; and a barrel having a discharge gas passage including a circumferential gas flow channel within an exterior surface of a gas block mounting body of the barrel;

wherein the gas block is separately formed from and is attached to the barrel.

6. The forend kit of claim 5 wherein:

at least a portion of the arcuate segment has a generally uniform radius from the longitudinal reference axis;

the longitudinal reference axis extends parallel to the first and second portions of the gas tube;

the first end portion of the gas tube and the first end of the central portion are located vertically above the longitudinal reference axis; and the second end portion of the gas tube and the second end of the central portion are located vertically below the longitudinal reference axis.

7. The forend kit of claim 1 wherein the first portion of the gas tube and the second portion of the gas tube extend parallel to each other.

8. The forend kit of claim 7 wherein a length of the central segment results in the first end of the central portion being up to 180 degrees away from the second end of the central portion relative to a longitudinal reference axis that extends generally parallel to at least one of the first portion of the gas tube and the second portion of the gas tube.

9. The forend kit of claim 1 wherein:

a length of the central segment results in the first end of the central portion being up to 180 degrees away from the second end of the central portion relative to a longitudinal reference axis that extends generally parallel to at least one of the first portion of the gas tube and the second portion of the gas tube; and at least a portion of the arcuate segment has a generally uniform radius from the longitudinal reference axis.

10. The forend kit of claim 9 wherein the first portion of the gas tube and the second portion of the gas tube extend parallel to each other.

11. The forend kit of claim 10 wherein:

wherein a length of the central segment results in the first end of the central portion being up to 180 degrees away from the second end of the central portion relative to a longitudinal reference axis that extends generally parallel to at least one of the first portion of the gas tube and the second portion of the gas tube; and at least a portion of the arcuate segment has a generally uniform radius from the longitudinal reference axis.

12. The forend kit of claim 1 wherein a length of the central segment results in the first end of the central portion being 180 degrees away from the second end of the central portion relative to a longitudinal reference axis that extends generally parallel to at least one of the first portion of the gas tube and the second portion of the gas tube.

13. The forend kit of claim 12 wherein the first portion of the gas tube and the second portion of the gas tube extend parallel to each other.

14. The forend kit of claim 12 wherein:

at least a portion of the arcuate segment has a generally uniform radius from the longitudinal reference axis;

the longitudinal reference axis extends parallel to the first and second portions of the gas tube;

the first end portion of the gas tube and the first end of the central portion are located vertically above the longitudinal reference axis; and the second end portion of the gas tube and the second end of the central portion are located vertically below the longitudinal reference axis.

15. The forend kit of claim 12, further comprising at least one of:

a gas block having a discharge gas passage including a circumferential gas flow channel within a central passage surface of the gas block; and a barrel having a discharge gas passage including a circumferential gas flow channel within an exterior surface of a gas block mounting body of the barrel;

wherein the gas block is separately formed from and is attached to the barrel.

16. The forend kit of claim 15 wherein:

at least a portion of the arcuate segment has a generally uniform radius from the longitudinal reference axis;

the longitudinal reference axis extends parallel to the first and second portions of the gas tube;

the first end portion of the gas tube and the first end of the central portion are located vertically above the longitudinal reference axis; and the second end portion of the gas tube and the second end of the central portion are located vertically below the longitudinal reference axis.

17. The forend kit of claim 1 wherein:

at least a portion of the arcuate segment has a generally uniform radius from a longitudinal reference axis;

the first end portion of the gas tube and the first end of the central portion are located vertically above the longitudinal reference axis; and the second end portion of the gas tube and the second end of the central portion are located vertically below the longitudinal reference axis.

18. The forend kit of claim 17 wherein the first portion of the gas tube and the second portion of the gas tube extend parallel to each other.

19. The forend kit of claim 17, further comprising at least one of:

a gas block having a discharge gas passage including a circumferential gas flow channel within a central passage surface of the gas block; and a barrel having a discharge gas passage including a circumferential gas flow channel within an exterior surface of a gas block mounting body of the barrel;

wherein the gas block is separately formed from and is attached to the barrel.

20. The forend kit of claim 1 wherein a length of the central segment results in the first end of the central portion being at least 180 degrees away from the second end of the central portion relative to a longitudinal reference axis that extends generally parallel to at least one of the first portion of the gas tube and the second portion of the gas tube.

21. The forend kit of claim 20 wherein the first portion of the gas tube and the second portion of the gas tube extend parallel to each other.

22. The forend kit of claim 20 wherein:

at least a portion of the arcuate segment has a generally uniform radius from the longitudinal reference axis;

the longitudinal reference axis extends parallel to the first and second portions of the gas tube;

the first end portion of the gas tube and the first end of the central portion are located vertically above the longitudinal reference axis; and the second end portion of the gas tube and the second end of the central portion are located vertically below the longitudinal reference axis.

23. The forend kit of claim 20, further comprising at least one of:

a gas block having a discharge gas passage including a circumferential gas flow channel within a central passage surface of the gas block; and a barrel having a discharge gas passage including a circumferential gas flow channel within an exterior surface of a gas block mounting body of the barrel;

wherein the gas block is separately formed from and is attached to the barrel.

24. The forend kit of claim 23 wherein:

at least a portion of the arcuate segment has a generally uniform radius from the longitudinal reference axis;

the longitudinal reference axis extends parallel to the first and second portions of the gas tube;

the first end portion of the gas tube and the first end of the central portion are located vertically above the longitudinal reference axis; and the second end portion of the gas tube and the second end of the central portion are located vertically below the longitudinal reference axis.

* * * * *